US008746508B2

(12) United States Patent
Staub

(10) Patent No.: US 8,746,508 B2
(45) Date of Patent: Jun. 10, 2014

(54) MULTI-COMPONENT CARTRIDGE

(75) Inventor: Andreas Staub, Hettlingen (CH)

(73) Assignee: Sulzer Mixpac AG, Haag (CH)

( * ) Notice: Subject to any disclaimer, the term of this patent is extended or adjusted under 35 U.S.C. 154(b) by 0 days.

(21) Appl. No.: 13/417,468

(22) Filed: Mar. 12, 2012

(65) Prior Publication Data

US 2012/0228329 A1 Sep. 13, 2012

(30) Foreign Application Priority Data

Mar. 11, 2011 (EP) ..... 11157782

(51) Int. Cl.
*B67D 7/70* (2010.01)

(52) U.S. Cl.
USPC ..... 222/137; 222/153.04; 222/145.5; 222/145.6

(58) Field of Classification Search
USPC ..... 222/145.6, 145.1, 94, 95, 105, 153.04, 222/153.12, 499, 519, 551, 562, 137, 145.5, 222/405, 547, 548
See application file for complete search history.

(56) References Cited

U.S. PATENT DOCUMENTS

| | | | | |
|---|---|---|---|---|
| 4,801,008 | A | 1/1989 | Rich | |
| 4,989,758 | A * | 2/1991 | Keller | 222/137 |
| 5,033,650 | A * | 7/1991 | Colin et al. | 222/137 |
| 5,609,271 | A * | 3/1997 | Keller et al. | 222/145.6 |
| 7,694,853 | B2 * | 4/2010 | Keller | 222/137 |
| 8,007,164 | B2 * | 8/2011 | Miyano et al. | 366/173.1 |
| 8,033,429 | B2 * | 10/2011 | Keller | 222/145.6 |
| 8,286,832 | B2 * | 10/2012 | Keller | 222/145.6 |
| 2008/0083782 | A1 * | 4/2008 | Heusser et al. | 222/145.5 |
| 2009/0127289 | A1 * | 5/2009 | Keller | 222/135 |
| 2010/0163579 | A1 * | 7/2010 | Keller | 222/137 |
| 2010/0200614 | A1 * | 8/2010 | Von Rotz et al. | 222/145.5 |
| 2010/0206904 | A1 * | 8/2010 | Staub et al. | 222/137 |
| 2011/0114668 | A1 * | 5/2011 | Bublewitz et al. | 222/41 |

FOREIGN PATENT DOCUMENTS

| | | |
|---|---|---|
| DE | 202006014087 | 12/2006 |
| DE | 102007044983 | 4/2009 |
| EP | 0421860 | 4/1991 |

OTHER PUBLICATIONS

EP Search Report for corresponding European Patent Application No. 11157782 dated Mar. 11, 2011.

* cited by examiner

*Primary Examiner* — Frederick C Nicolas
*Assistant Examiner* — Bob Zadeh
(74) *Attorney, Agent, or Firm* — K&L Gates LLP

(57) ABSTRACT

A dispensing apparatus for mixing and dispensing multi-component masses including a multi-component cartridge or syringe having a plurality of chambers, a mixer element having a longitudinal axis and a mixer housing placed over the mixer element. The outer surface of the mixer element and the inner wall of the mixer housing have a cooperating guide element which only allows a displacement of the mixer housing at the mixer element along the longitudinal axis of the mixer element. The mixer housing is axially displaceably connected to the multi-component cartridge. The mixer housing and the mixer element are displaceable against one another in an axial direction in the closed and dispensing positions. A rotary element, the mixer housing and the multi-component cartridge have a cooperating interaction element in which the rotary element rotates such that an axial relative movement results between the mixer housing and the multi-component cartridge.

14 Claims, 14 Drawing Sheets

MULTI-COMPONENT CARTRIDGE

PRIORITY CLAIM

The present application claims priority to European Patent Application No. 11157782.1 filed on Mar. 11, 2011, the disclosures of which are incorporated herein by reference.

BACKGROUND

The disclosure relates to a dispensing apparatus for the mixing and dispensing of multi-component masses.

An apparatus for mixing and dispensing of multi-component masses is described in DE 102 54 409 A1. The apparatus includes a cartridge having at least two cylindrical chambers arranged in parallel for receiving the components and having a respective piston for the squeezing out of the components. The chambers have outlet openings which are covered and locked by a circular inner surface of a cap. The cap has a curved outlet tube which surrounds a mixing coil. The mixing coil is of flexible design and respectively curves in the direction of the outlet tube. The mixing coil is attached to a transverse wall formed at a cylinder-shaped projection of the cartridge head. The transverse wall is held in a recess of the cap with respect to rotation. The cap is lifted from the locking position by an application of pressure from the components and the dispensing openings are released, wherein the components exiting from the outlet openings are separated from one another by the transverse wall so that the respective component cannot arrive in the chamber of the other respective component without any further ado. The transverse wall no longer engages in the cap recess in the open position of the cap so that the cap and therefore also the outlet tube can be rotated into the direction desired by the applicant. For securing the open position and also the locking position of the cap, the cylindrically shaped projection has a ring-shaped bulge which can engage in the corresponding recess, wherein the cap alone jumps from the locked position into an open position because of the pressure from the components.

The placing of the cap with the dispensing tube over the mixing coil is complicated by the possibility of the rotation of the dispensing tube into a suitable dispensing position and the use of a flexible mixing coil connected therewith. Moreover, the structure of the mixing coil is sensitive with regard to mechanical damage, so that the sensitive flexible mixing structure must be placed carefully into the dispensing tube, wherein one simultaneously has to pay attention on the correct seating of the cap at the cylindrical projection. Also the displacement of the cap between the open and the locked position runs the risk of a tilting of the cap and the damage of the mixing coil.

In order to simplify the placing of the dispensing tube at a multi-component cartridge, a dispensing apparatus having an adapter element is suggested in DE 20 2006 004 738 U1. In this respect an adapter element is arranged between the spray body, on the one hand, and the mixer unit, on the other hand, wherein the adapter element is arranged in an exchangeable manner at the spray body and the mixing unit is arranged in an exchangeable manner at the adapter element.

The dispensing apparatus known from the prior art do not ensure that the dispensing tube can be arranged cleanly at the spray part in a simple manner on application without damaging the mixing coil. Also the danger is present that the dispensing tube is not cleanly placed at the spray part so that on pressing out of the syringe, the component can laterally emerge at the connection positions between spray parts and dispensing tube.

It is the object of the present disclosure to provide a simply constructed dispensing apparatus for mixing and dispensing of multi-component masses which avoids the previously mentioned disadvantages, prevents an unwanted dispensing or mixing of the individual components and enables a to and fro movement of a closure element between an open and a locked position of the dispensing apparatus.

SUMMARY

The dispensing apparatus in accordance with the disclosure for the mixing and dispensing of multi-component masses includes a multi-component cartridge or a multi-component syringe having a plurality of, in particular cylindrical, chambers, wherein, in particular double-cartridges or double-syringes having two chambers are preferred. In the following, the term multi-component cartridge is used in a representative manner for all embodiments. The chambers, this means the inner space of the cartridges can be formed circular cylindrically or have an elliptical or polygonal cross-section. In the filled state the chambers each include a fluid component of a filling mass. This filling mass is separated from the environment as a rule by a cartridge piston freely displaceable in chamber. The cartridge piston includes sealing elements which close the chamber contents fluid-sealingly from the environment. The components in the chambers of the multi-component cartridge are dispensed with the aid of a dispensing plunger which cooperates with the corresponding cartridge piston such that the cartridge pistons can be displaced in the chamber.

The multi-component cartridges also have a formation serving as an outlet part beside the cylindrical chambers. In this respect the outlet part, for example, relates to a completeness of tube-like formations of the individual chambers and/or to a cylindrical outlet part. The outlet part can be overlapped by the rotary cap and has a dispensing opening at the mixer side for each component, this means that the individual components are kept separately from one another up to the mixing side end of the outlet part, so that a preliminary mixing of the components is prevented. The dispensing openings can thereby be held fluid-tight by means of the rotary cap, so that the components can be stored in the chambers of the multi-component cartridge for longer periods of time and can also be transported in the multi-component cartridge.

The dispensing apparatus also has a longitudinal mixing element which is formed as a unitary piece with the multi-component cartridge and a mixer housing which can be placed over the mixing element. Under a defined mixing element it is intended a mixing element formed as a unitary piece with the multi-component cartridge, that means that the multi-component cartridge and the mixing element are configured as one single piece.

Each chamber of the multi-component cartridge has a dispensing opening which can be closed by closure elements defined at the mixer housing, wherein the outer surface of the mixer element and the inner wall of the mixer housing have a cooperating guide element which allows a displacement of the mixer housing at the mixer element only along the longitudinal axis of the mixer element. The mixer housing is axially displaceably connected to the multi-component cartridge by a connection element. The multi-component cartridge can be transferred from a closed position locking the dispensing openings into a dispensing position releasing these.

The guide element is, in particular designed such that the mixer housing and the mixer element are displaceable only in an axial direction towards one another between the closed position and the dispensing position both on the whole path between these two positions. The connection element is a rotary element, wherein the rotary element, the mixer housing and the multi-component cartridge have a cooperating interaction element which is designed such that through rotation of the rotary element an axial relative movement between mixer housing and multi-component cartridge results.

Preferably the mixer element and the multi-component cartridge are formed from one piece, wherein the mixer element and the multi-component cartridge are then composed of the same material. In this respect the mixer element forms a formation at the outlet part of the multi-component cartridge, wherein the mixer element lies between the dispensing openings of the cartridge for this purpose. The mixer element is preferably of form-stable design and at least at room temperature has a solid shape so that it solidly projects from the multi-component cartridge. For this purpose the mixer element is a cylindrical or spherical shaped element having an elliptical or polygonal cross-section. Preferably, the mixer element is of cylindrical design and has a rectangular cross-section. This particular embodiment has the advantage that on the construction of the mixer element and the mixer housing an error-free setting of the mixer housing onto the mixer element is prevented. It is further preferred in this respect that the mixer element has two longitudinally closed mixer walls, wherein the two other mixer longitudinal walls are of open design.

The mixer element has a longitudinal middle axis which in the following is also referred to as longitudinal axis. The longitudinal middle axis of the chambers of the multi-component cartridge preferably all lie parallel to one another. Very preferably the dispensing apparatus is designed such that the longitudinal middle axis of the chamber and the longitudinal axis of the mixer elements all lie parallel to one another. In the following always the direction of the longitudinal axis of the mixer element is understood to be the axial direction of the dispensing apparatus.

The dispensing apparatus also has a mixer housing placeable over the mixer element. The mixer housing has a preferably conically tapering outlet region having a dispensing opening at the end remote from the outlet part of the multi-component cartridge. At the cartridge side end, the mixer housing has a closure element for locking at least one of the dispensing openings of the chambers. Closure plugs defined at the mixer housing are preferably used as closure elements. The closure plugs are designed, in particular as closure elements formed at the mixer housing. Thus, the closure plugs and the mixer housing are preferably formed as one piece from the same material.

The multi-component cartridge, the mixer element and the mixer housing are preferably made of the same material. In particular plastic is suitable as material, wherein all plastics which can be processed to form-stable substantially rigid structures can be used. Specifically preferred are polypropylene (PP), polyoximethylene (POM) and acrylonitrile-butadiene-styrene copolymerisate (ABS).

In a first embodiment of the dispensing apparatus in accordance with the disclosure, the inner space including the mixer element of the mixer housing has a shape match fit with regard to the mixer element, wherein a minimum play is present for ensuring an axial displacement of the mixer housing at the mixer element. In this respect a formation similar to a form fit of the inner wall of the mixer housing and the outer wall of the mixer elements form the required axial guide element in order to ensure that the displacement of the mixer housing at the mixer element is only possible along the longitudinal axis of the mixer element.

In a further embodiment of the dispensing apparatus in accordance with the disclosure the guide element for the axial displacement of the mixer housing at the mixer element is not formed by a match fit with the mixer element at the mixer housing, but rather by at least one tongue and groove arrangement extending in axial direction. In this respect only a single axially running tongue and groove arrangement can be used or, however, also a plurality of separately arranged axially running tongue and groove arrangements can be used. The groove can be respectively found in the mixer element, wherein a tongue-like formation is then required at the mixer housing or the groove can be arranged at the inner side of the mixer housing, wherein then a tongue-like formation is required at the outer wall of the mixer element in this second case.

The mixer element is axially displaceably connected to the multi-component cartridge by means of a connection element. Essential in this respect is that the mixer housing having the formed closure plugs for the dispensing openings of the chambers is moveable from a locking position locking the dispensing openings into a dispensing position releasing these. It is further essential that the axial guide element is configured such that the mixer housing and the mixer element are only displaceable in the axial direction towards one another between the closure and dispensing position as well as the overall path between these two positions.

The rotary element connecting the multi-component cartridge to the mixer housing is, in particular a rotary cap, which is either rotatable relative to the multi-component cartridge or to the mixer housing, however, is rotationally fixed in the axial direction. The rotary cap is a cup-shaped element having a lid with a centrally arranged recess for guiding through the mixer housing and a surrounding wall. The lid, in particular has a substantially rotationally symmetric shape. The surrounding wall, in particular has an open boundary region.

In accordance with an alternative embodiment the rotary element can be a screw nut and the mixer housing or the multi-component cartridge can have a winding cooperating therewith.

The attachment of the rotary element, i.e. in particular the rotary cap at the multi-component cartridge or at the mixer housing takes place, for example, by means of a snap and lock connection or by means of a bayonet connection.

A snap and lock connection is preferably formed thereby that the rotary cap has an at least partially surrounding ring-shaped bead-like indentation and an at least partially surrounding ring-shaped molding or groove corresponding therewith at the outer surface of the multi-component cartridge or at the outer surface of the mixer housing.

The outer surface is, in particular the outer surface of the outlet part.

The free boundary region of the rotary cap is elastically deformable for the placing over of the bulged-shaped indentation over the ring-shaped molding or groove at the outlet part of the multi-component cartridge or the mixer housing.

The rotary cap can be fixed in the closed position and/or in the dispensing position of the multi-component cartridge, in particular by means of a bayonet connection.

In accordance with an advantageous embodiment, the rotary cap has a rotary cap slot running helically in the longitudinal direction of the mixer element and the mixer housing has a guide element cooperating with the rotary cap slot, in particular a housing button. In accordance with an advantageous variant a further slot element adjoins at least one end of the rotary cap slot in a normal plane with regard to the longitudinal axis of the rotary cap which forms a bayonet security together with the guide element.

In accordance with a further advantageous embodiment, the mixer housing has a housing groove running helically at its outer surface in the longitudinal direction of the mixer element and the rotary cap has a guide element, in particular a rotary cap button, cooperating with the housing groove.

In accordance with a further advantageous variant a further groove element adjoins at least one end of the housing groove in a normal plane with regard to the longitudinal axis of the mixer housing, said groove element forming a bayonet security together with the guide element.

The rotary cap slot or the housing groove are advantageously formed such that the rotation of the rotary cap about the longitudinal axis of the mixer element from the closed position to the dispensing position amounts to 270° and less, in particular to 90° to 180° with regard to a full circle of 360°.

The axial relative movement between the mixer housing and the multi-component cartridge from the closed position to the dispensing position amounts to preferably 0.5 mm to 4 mm, in particular 1 mm to 3 mm.

The outer surface of the rotary cap can have axially running rotary wings or an axially running fluting distributed over the circumference for the improved manual torque transfer.

In particular the mixer element and the mixer housing have cooperating coding means so that the mixer housing can only be placed onto the mixer element in a predetermined position.

The multi-component cartridge has an outlet part at the mixer side end which is overlappingly formed by the mixer housing and the outer surface of the outlet part and/or the inner wall of the mixer housing has/have sealing means in order to prevent a leaking emergence of the component between the mixer housing and the multi-component cartridge during the expulsion of the components to be mixed from the chambers.

The multi-component cartridge in accordance with the disclosure can be designed as a guide element for the axial displacement of the mixer housing in accordance with an advantageous embodiment of the mixer element in order to enable the positioning and displacement of the mixer housing at the outlet part of the multi-component cartridge. In order to ensure a fixation of the mixer housing in an open position and/or in a closed position of the mixer housing additional interaction means can be provided in an advantageous embodiment of the disclosure at the outlet part and/or at the outer wall of the chambers and/or at the mixer housing, in particular latching noses and corresponding latching grooves can be provided. Hereby, on the one hand, the components can be dispensed interference-free, on the other hand, however, the chambers can be sealingly closed, whereby a drying up or premature hardening of the components present in the chamber can be prevented. Dispensing openings of the chambers can be sealingly closed particularly advantageously by corresponding sealing elements arranged at the mixer housing. Furthermore, the latching noses and grooves help to ensure the user that the mixer housing is present in the correct position.

Additional features and advantages are described herein, and will be apparent from the following Detailed Description and the figures.

DETAILED DESCRIPTION

Figure 1:
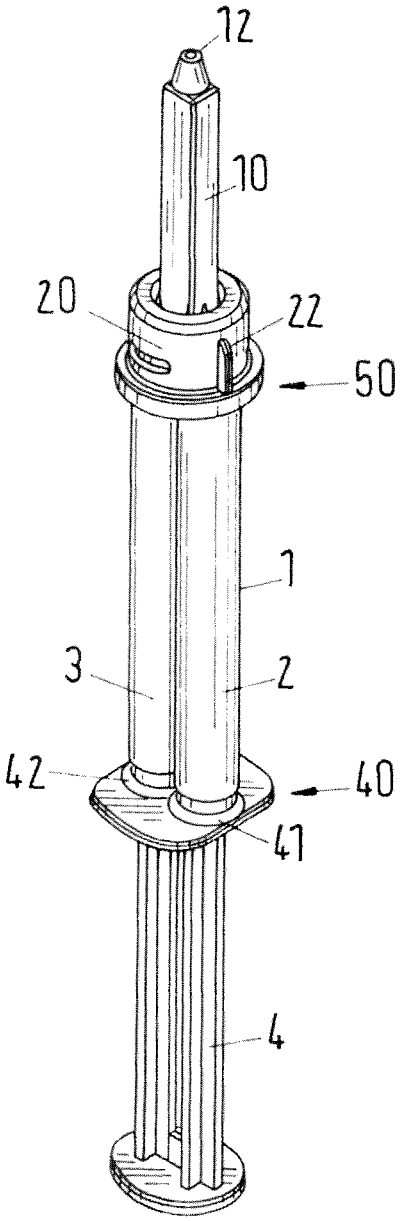
FIG. 1 is a perspective view of a multi-component cartridge with fitted mixer housing and dispensing plunger.

FIG. 1 shows a dispensing apparatus in accordance with the disclosure for the mixing and dispensing of multi-component masses in accordance with a preferred embodiment. The multi-component cartridge 1 designed as a double syringe in FIG. 1 has a container having two substantially cylindrical and fixedly connected chambers 2, 3 for the reception of different components. The components in this example are the two components of a two-component glue, which are only allowed to be mixed with one another shortly before the dispensing onto the objects to be glued. However, also other components can be stored in the chambers, for example forming masses for dental applications. Principally, the present multi-component cartridge is suitable, in particular for all applications, in which small amounts of the components should be applied once.

Figure 3:
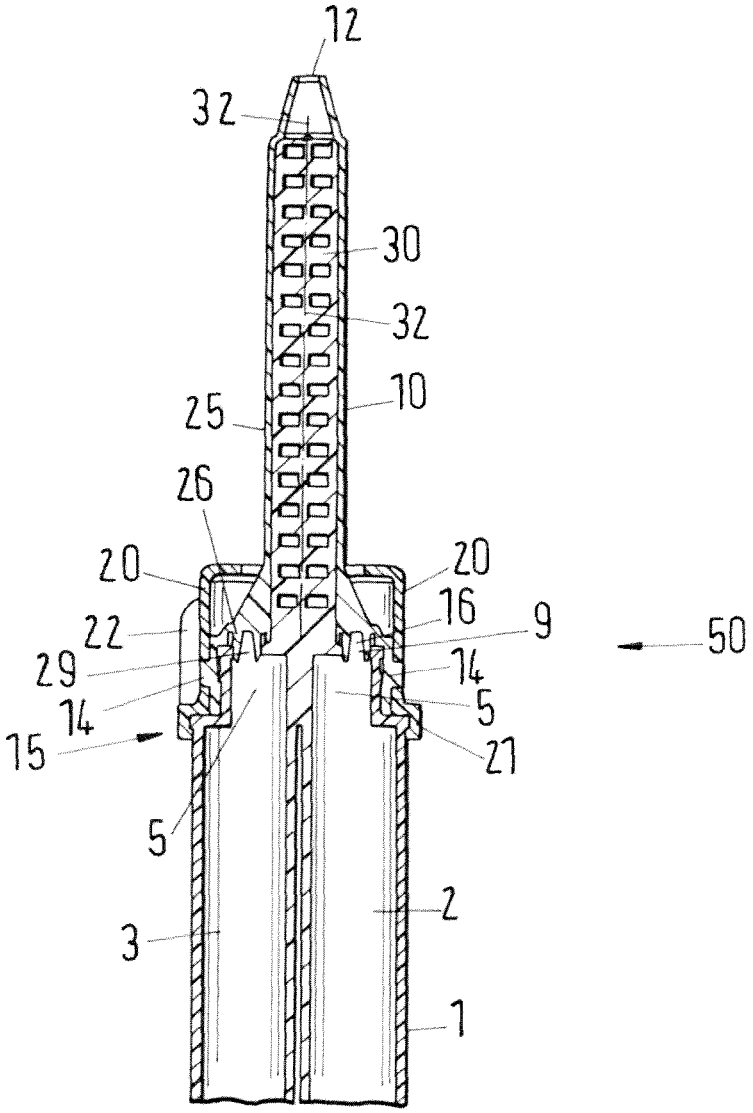
FIG. 3 is a cross-section through the dispensing side end of the multi-component cartridge of FIG. 1.

The multi-component cartridge has an inlet end 40 and an outlet end 50. The inlet end 40 includes inlet openings 41, 42 by means of which the chambers 2, 3 can be filled with the corresponding components. The outlet end 50 includes an outlet part 5 which is shown in FIG. 3. In order to press the components out of the chambers 2, 3 the multi-component cartridge has a dispensing plunger 4 which can be pressed from below the inlet end 40 of the multi-component cartridge in FIG. 1. The dispensing plunger has a corresponding piston element for each of the chambers 2, 3 which are displaceable along the inner wall of the chambers. The components present in the chambers are pushed in the direction of the outlet part 5 on a movement of these pistons in the direction of the outlet end 50. The outlet part 5 includes dispensing openings 9, 29 which in turn are visible in FIG. 3.

A mixer housing 10 is arranged at the outlet end 50 of the chambers 2, 3 which is designed as a dispensing tube. The mixer housing in accordance with FIG. 1 has a substantially quadratic cross-section and a dispensing opening 12 for dispensing the components to be discharged mixed on a path through the mixer housing. The mixer housing includes a mixer element 30, not illustrated in this example, which will be described in more detail in the following in accordance with FIG. 3 which shows the mixer element 30. The mixer element is connected as one piece to the outlet part 5, this means that the mixer element is manufactured in a single work step as part of the multi-component cartridge.

The mixer housing is placed over the mixer element and is held in a correspondingly designed rotary element in a closed position shown in FIG. 1. The rotary element of FIG. 1 is designed as a rotary cap 20. The rotary cap is rotatable relative with regard to the multi-component cartridge 1 or the mixer housing 10.

Figure 2:
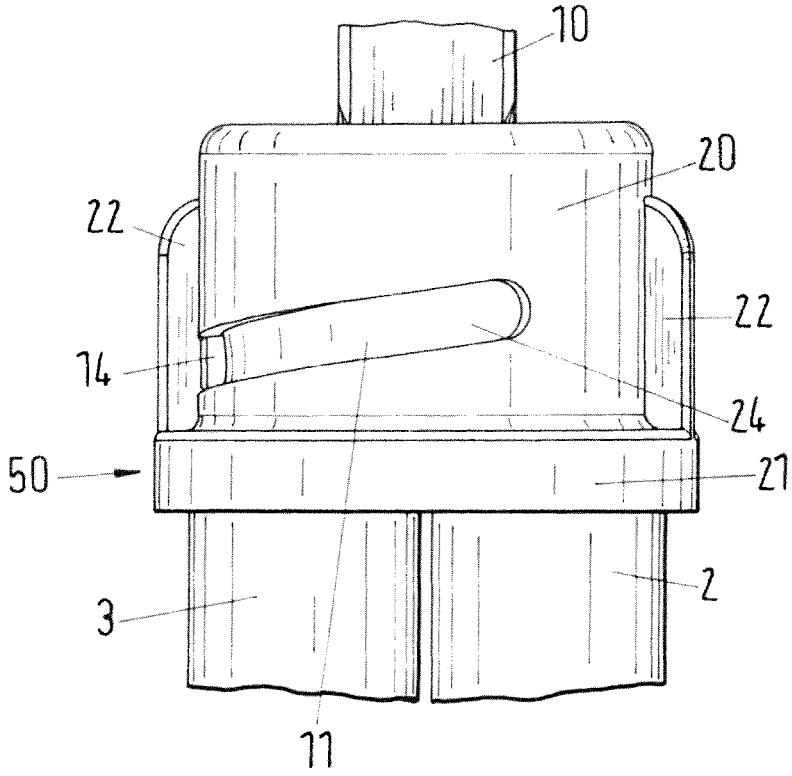
FIG. 2 is a view of a section of the multi-component cartridge of FIG. 1.

FIG. 2 shows a section of a view of the multi-component cartridge 1 which shows the outlet end 50 as well as a part of the mixer housing 10. The outlet end 50 is covered by the rotary cap 20. The rotary cap 20 is a cup-like element which has a base having an opening through which the mixer housing 10 can be stuck through. A cover element is connected to the base which opens into a free boundary region 21. At least one rotary wing 22 is attached at the cover element and/or at the free end region 21. When the mixer housing 10 should be displaced into a rotary movement it is simplified for the user to carry out the rotary movement of the rotary cap and/or to hold the rotary cap by means of the rotary wing 22.

The rotary cap 20 holds the mixer housing 10, wherein the mixer housing 10 has an inlet end which is designed as a collar 11. Only a small part of the collar 11, which is largely covered by the rotary cap 20, is visible which is set free by the rotary cap slot 24. A housing button 14 is arranged at the outer cover surface of the collar 11. The housing button 14 is displaceable along a track predetermined by the rotary cap slot 24 through a rotary movement of the mixer housing 10 or the rotary cap 20. An arbitrary design of projection is to be understood as a housing button which has a shape matching to the rotary cap slot so that a relative movement of rotary cap slot and housing button is not prevented. In particular the housing button has a width smaller than the width of the rotary cap slot.

As emerges from FIG. 3, in which the outlet end 50 of the multi-component cartridge 1 as well as the mixer housing 10 are shown in section, a mixer element 30 having numerous deflection elements is provided at an outlet part 5 of the multi-component cartridge 1. The mixer element 30 forms a single component with the multi-component cartridge 1. The longitudinal mixer element 30 has a mixer housing 10 which can be placed over the mixer element 30. The mixer housing 10 and the mixer element 30 are defined by the rotary cap 20.

The chambers 2, 3 are extended duct-like towards the outlet openings 9, 29 in the outlet part 5. The components can be dispensed from the chambers 2, 3 into the mixing space formed by the fitted mixer housing 10 by the dispensing openings 9, 29 when the mixer housing is in the open position shown in FIG. 6.

Each of the dispensing openings 9, 29 can be closed by closure elements 16, 26 defined at the mixer housing 10. The closure elements can, in particular be designed as closure plugs. The outer surface of the mixer element 30 and the inner wall of the mixer housing 10 have cooperating guide elements which allow a displacement of the mixer housing 10 at the mixer element 30 only along the longitudinal axis 32 of the mixer element 30. The mixer element is axially displaceably connected to the multi-component cartridge 1 by means of a connection element, wherein the multi-component cartridge 1 is transferable from a locking position closing the dispensing openings 9, 29 into a dispensing position releasing these. The guide elements are designed such that the mixer housing 10 and the mixer element 30 are moveable only in an axial direction between these two positions against one another between the locking and dispensing position as well as on the overall path between these two positions.

The rotary element 20, the mixer housing 10 and the multi-component cartridge 1 have a cooperating interaction element 14, 24 which is designed such that an axial relative movement between the mixer housing 10 and multi-component cartridge 1 results by means of rotation of the rotary element 20. The interaction element is, in particular designed as a housing button 14 or as a cap bead.

The rotary cap 20 is attached at the outlet 5 or at the outer wall of the chambers 2, 3 by means of a snap connection 15. The snap connection 15 is present in the region of the free boundary region 21 of the rotary cap. The free boundary region 21 includes a groove at its inner side in which an associated projection of the outlet part 5 or the outer wall of the chambers 2, 3 interacts. Preferably the free boundary region is elastic, so that a placing over the outlet part or the outer wall takes place by means of a small deflection of the same on application of an axial pressure force.

Figure 4:
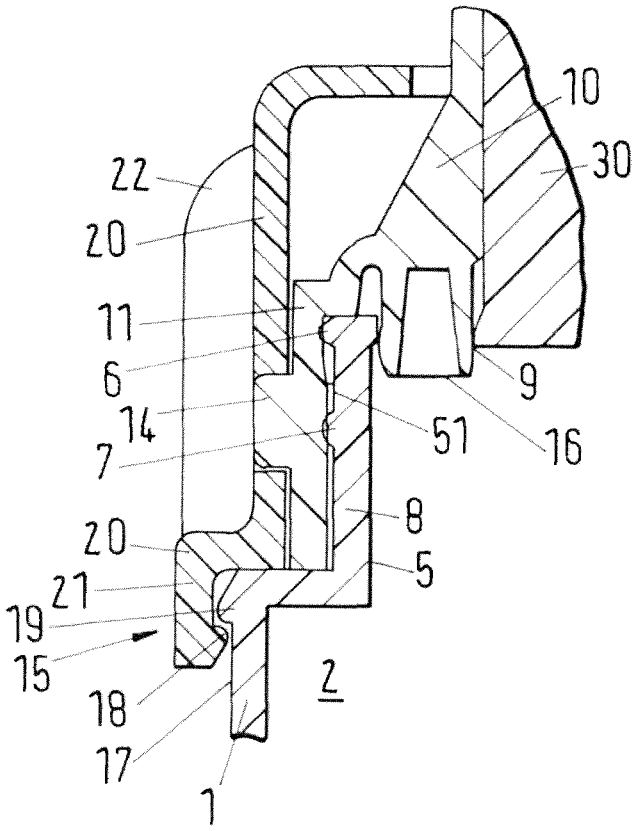
FIG. 4 is a detailed view of the connection of the rotary cap with the mixer housing and the dispensing neck in accordance with FIG. 3.

In FIG. 4 a section of FIG. 3 is shown which shows the function of the interaction elements 18, 19 as well as the snap connection 15 in detail. Hereby the same parts have the same reference numerals as those in FIG. 3. For this purpose, FIG. 3 shows a part of the dispensing neck 8, which opens into the partially shown dispensing opening 9. The dispensing opening 9 is closed by a closure plug 16 in the present illustration which plug is a component of the mixer housing 10. The mixer housing 10 has a mixer housing collar 11 which is placed over the dispensing neck. The mixer housing 10 is fluid sealingly connected to the dispensing neck 8 via a first sealing projection 6 and a second sealing projection 7 so that the components present in the chamber 2 cannot emerge from the chambers in the closed state.

The mixer housing 10 can be moved in the axial direction, this means substantially in the direction of the longitudinal axis 32 of the mixer element 30 for which purpose the rotary cap 20 is provided. The rotary cap 20 has an at least partially surrounding ring-shaped bulge-shaped indentation 18. At the outer surface 17 of the multi-component cartridge 1 a therewith corresponding, at least partially surrounding ring-shaped formation 19 or groove is formed and the free boundary region 21 of the rotary cap 20 is elastically deformable for placing over the bulge-shaped indentation 18 over the ring-shaped formation 19 or groove of the multi-component cartridge 1 or the mixer housing 10.

It is also prevented that the mixer housing 10 can be taken from the multi-component cartridge 1 by accident, for example on opening by means of provision of a snap connection at the rotary cap 20. The multi-component cartridge, this means, in particular the outer wall of the chambers 2, 3 or their outlet part 5 have a latch projection 19 at their dispensing side end which on placing of the mixer housing 10 and of the rotary cap 20 can be pressed outwardly due to the flexibly designed interaction element which is illustrated in this example as a bulge-shaped indentation 18 of the free boundary region 21 of the rotary cap 20. The bulge-shaped indentation 18 is in interaction with the latching projection 19 and thus prevents its removal following the placing of the mixer housing 10.

The inner side of the mixer housing collar 11 has two substantially ring-shaped closure elements 16, 26 tapering inwardly with regard to the dispensing side and truncated cone-like in cross-section in order to sealingly close the dispensing openings 9, 29 in the closed position of the mixer housing 10. The closure elements 16, 26 enable the locking of the dispensing openings 9, 29 due to their specific shape, wherein for the retraction of the closure elements 16, 26 from the dispensing openings 9, 29 a certain force has to be overcome which ensures the sealing ability in the closed state.

The guiding of the mixer housing 10 and the mixer element 30 is ensured by their quadratic inner and/or outer contour matched to one another the cross-section of both the mixer element 30 and also of the mixer housing 10 is thus substantially quadratic in the embodiment of the disclosure illustrated in the drawings. So that the components can be pressed through the mixer element 30 as completely as possibly, the distance between the inner contour of the mixer housing 10 and the outer contour of the mixer housing 30 is as small as possible, wherein the movement of the mixer housing 10 must still be possible. Additionally, an erroneous placing of the mixer housing 10 onto the mixer element 30 is prevented by coding means clearly visible from the outside, such as for example an elliptical shape of the mixer housing collar 11 as well as of the dispensing neck 8 of the multi-component 1. Since the mixer element 30 is made of a form-stable material, a secure guiding of the mixer housing 10 in axial longitudinal direction of the multi-component cartridge is ensured.

In an alternative embodiment of the disclosure the outer contour of the mixer element 30 and the inner contour of the mixer housing 10 are rectangular, i.e. have a substantially rectangular cross-section so that already hereby a guiding security against rotation of the mixer housing 10 is ensured. Moreover, it is advantageous for such an embodiment that a mixer housing 10 can placed onto the mixer element 30 in the position required for the secure sealing and interaction of the closure element 16, 26 in the dispensing openings 9, 29. In this case, the mixer housing collar 11 of the mixer housing 10 and the dispensing neck 8 of the multi-component cartridge 1 can also have shapes with other cross-sections, for example circular. It is nevertheless ensured that the dispensing openings 9, 29 and the closure elements 16, 26 constantly interact with one another by means of the specific formation of the mixer element 30.

Figure 5:
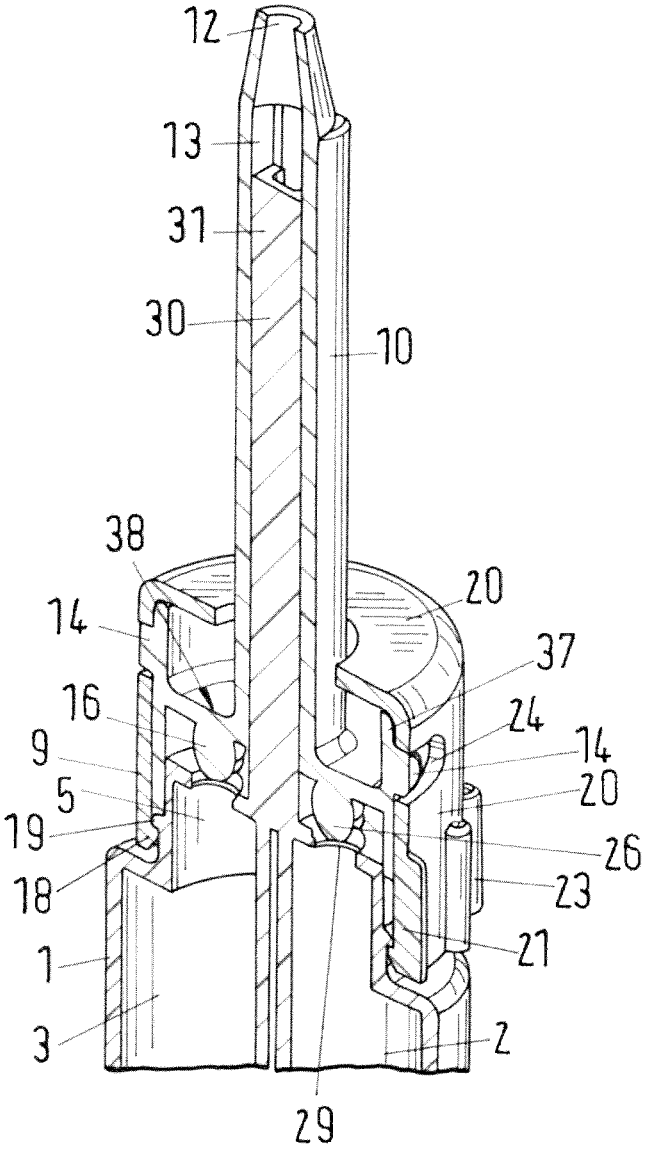
FIG. 5 is a three-dimensional view of a variant of the dispensing side end of the multi-component cartridge as well as of the rotary cap and of the mixer housing.

FIG. 5 shows a variant which shows a different mixer element 30, a modified rotary cap 20 as well as an alternative embodiment of the closure elements 16, 26. Parts with equal function have the same reference numerals like those in the previous FIGS. 1 to 4. The guide elements for the axial displacement of the mixer housing 10 at the mixer element 30 are formed by a form-fitting-like formation of the inner wall 13 of the mixer housing 10 and the outer wall 31 of the mixer element 30, wherein at least the outer wall 31 of the mixer element 30 and the inner wall 30 surrounding the mixer element 30 of the mixer housing 10 each have a polygonal, in particular rectangular or elliptical cross-section.

In the variant illustrated in FIG. 5 the dispensing apparatus is shown in the open state, so that the filling mass which is a mixture of the components present in the chambers 2, 3 can be dispensed through the dispensing openings 12 of the mixer housing 10. An axial displacement of the mixer housing 10 relative to the cartridge 1 and/or its mixer element 30 takes place by rotation of the rotary cap 20. The housing button 14 in this variant is not attached at the mixer housing collar 11, but rather at a projection 37 which interacts in a corresponding rotary cap slot 24. The projection 37 extends from a connection piece 38 of the mixer housing supporting the closure elements 16, 26. The closure elements 16, 26 are arranged at the connection piece 38 at the side which is facing the cartridge 1. The closure elements 16, 26 have a cross-sectional area which is larger in the closed state than in the open state. In the opened state the corresponding components can flow past the corresponding closure elements. In accordance with FIG. 5 the closure elements have a ball-like shape.

Figure 6:
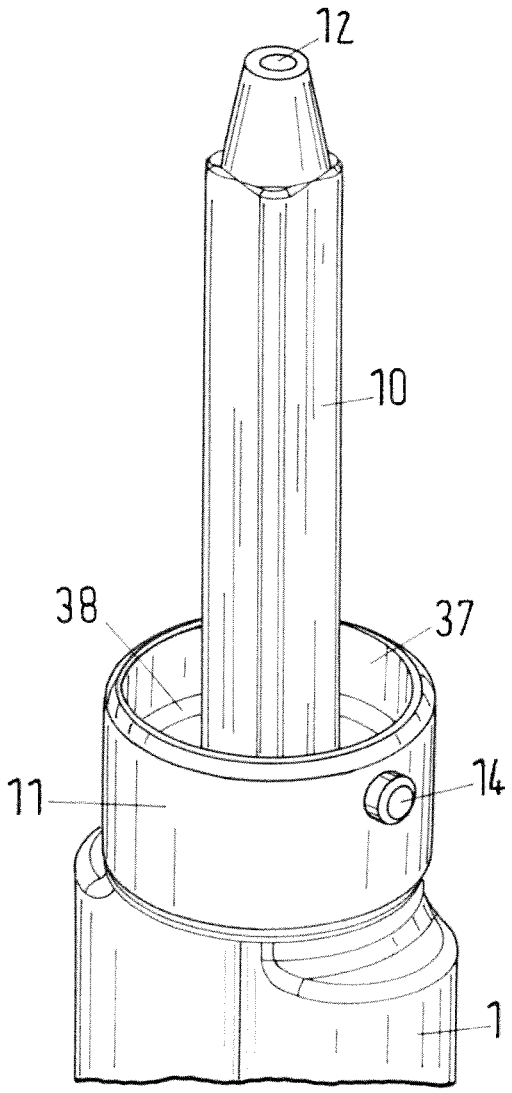
FIG. 6 is a schematic view of the fitted mixer housing without the rotary cap.

FIG. 6 shows a schematic view of the mixer housing 10 placed onto the multi-component cartridge 1 without rotary cap. In this illustration the interaction element is visible which is designed as a housing button 14. A plurality of housing buttons can be attached at the outer cover surface of a mixer housing collar 11. In FIG. 5 two housing buttons 14 are illustrated which are arranged lying opposite to one another. Furthermore, the projection 37 is illustrated as a cylindrical ring-shaped element which extends from the connection piece 38 in the direction of the mixer housing 10.

Figure 7:
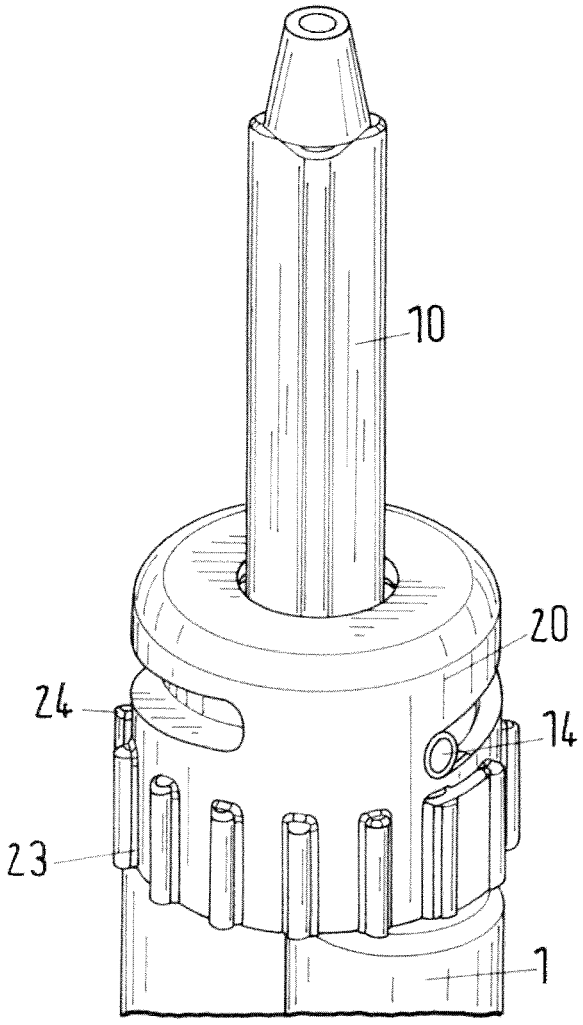
FIG. 7 is the view of FIG. 6 with fitted rotary cap in the closed position.

FIG. 7 shows the view of FIG. 6 with a fitted rotary cap in closed position. In the closed position the closure elements 16, 26 illustrated in FIG. 5 interacts with the corresponding dispensing openings 9, 29. The housing button 14 is then present in the position in which it lies closest to the multi-component cartridge 1, i.e. at the lower end of the rotary cap slot 24 in the position of FIG. 7.

The rotary cap has a fluting 23 at its cover surface. Instead of the same also rotary wings in accordance with the embodiments of FIG. 1 to FIG. 4 can be provided.

FIGS. 8 to 11 show a variant in accordance with which the guide element for the axial displacement of the mixer housing 10 at the mixer element 30 are formed by a tongue and groove arrangement running at least in an axial direction.

Figure 8:
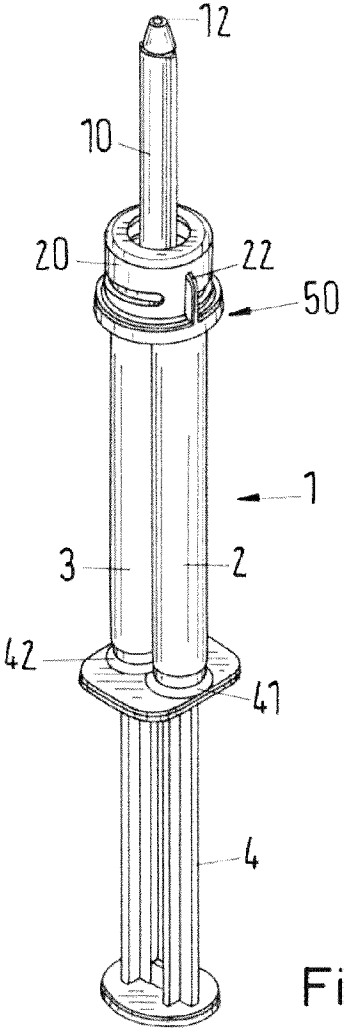
FIG. 8 is another embodiment of the apparatus according to the disclosure.

FIG. 8 shows a second embodiment of a dispensing apparatus in which in turn parts of equal function are referred to using the same reference numerals. In the following only the differences to the first embodiment will be explained, otherwise one is referred to the first embodiment.

Figure 9:
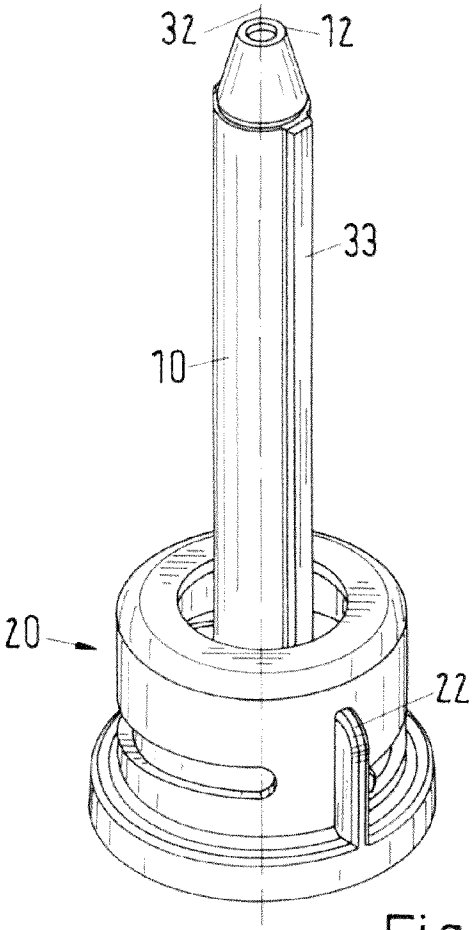
FIG. 9 is a detail of the mixer housing and the rotary cap for the dispensing apparatus of FIG. 8.

FIG. 9 shows a detail of a mixer housing and the rotary cap for the second embodiment. The mixer housing 10 has the shape of a substantially cylindrical tube whose cross-section is substantially circular or elliptical. The mixer housing 10 has a guide element 33 which is displaceable along this relative to the mixer element 30 in the direction of the common longitudinal axis 32.

Figure 10:
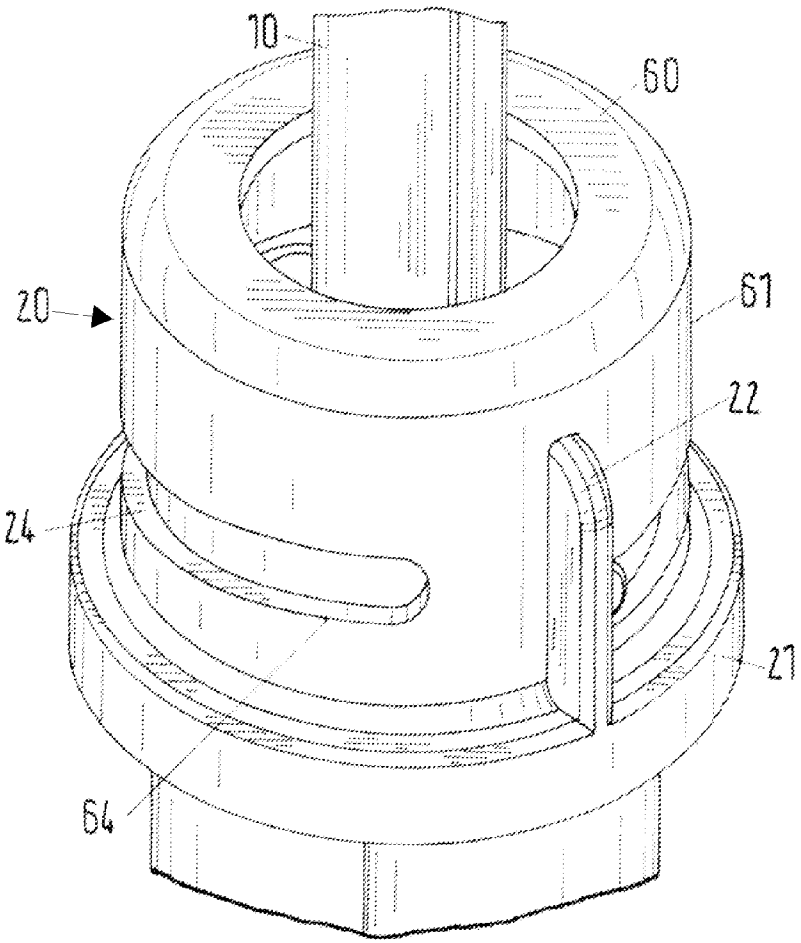
FIG. 10 is a detail of the rotary cap of the dispensing apparatus of FIG. 8.

FIG. 10 shows a detail of the rotary cap 20 of the second embodiment. The rotary cap 20 is equipped with a rotary wing 22 and is a cup-like element as shown in FIGS. 1 to 4 which has a base 60, a cover element 61 which includes a rotary cap slot 24 as is shown in FIG. 2, however, the rotary cap slot 24 includes an extension which is designed as a slit element 64 in contrast to the first embodiment. This slit element 64 forms a bayonet security with the housing button. The slit element 64 extends over a part of the circumference of the cover element 61 and is arranged in a normal plane with regard to the longitudinal axis of the rotary cap 20.

Figure 11:
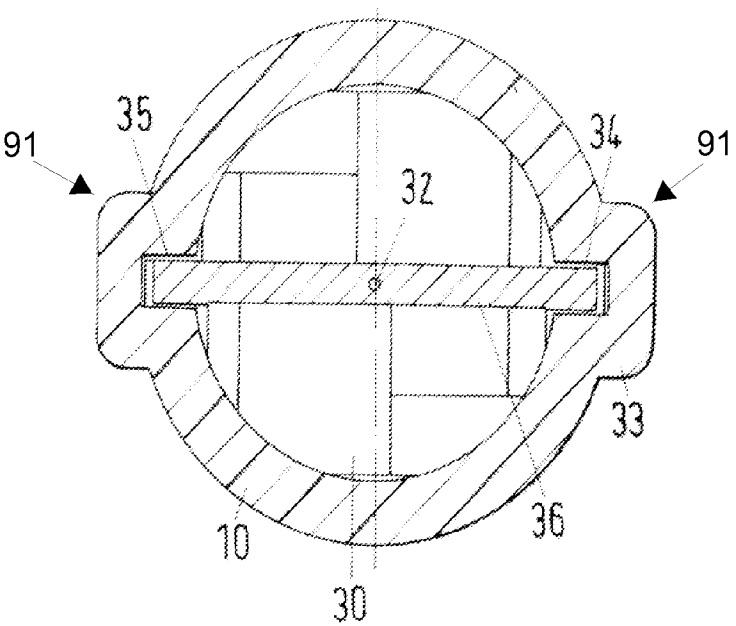
FIG. 11 is a section through the mixer housing in accordance with the apparatus of FIG. 8.

FIG. 11 is a section through the mixer housing in accordance with the second embodiment. The mixer element 30 is received in a groove 34 of the guide element 33 of the mixer housing 10. Also a plurality of such grooves 34 can be provided, in particular a first groove 34 and a second groove 35 can be provided which are mirror-symmetrically arranged with regard to one another. In accordance with this embodiment the plane of symmetry runs along the longitudinal axis 32 of the mixer element 30 and is aligned normal to the middle wall 36 of the mixer element. Thus, as illustrated in FIG. 11, the guide element 33 may be formed by one or more tongue and groove arrangements 91 which extend in axial direction.

Figure 12:
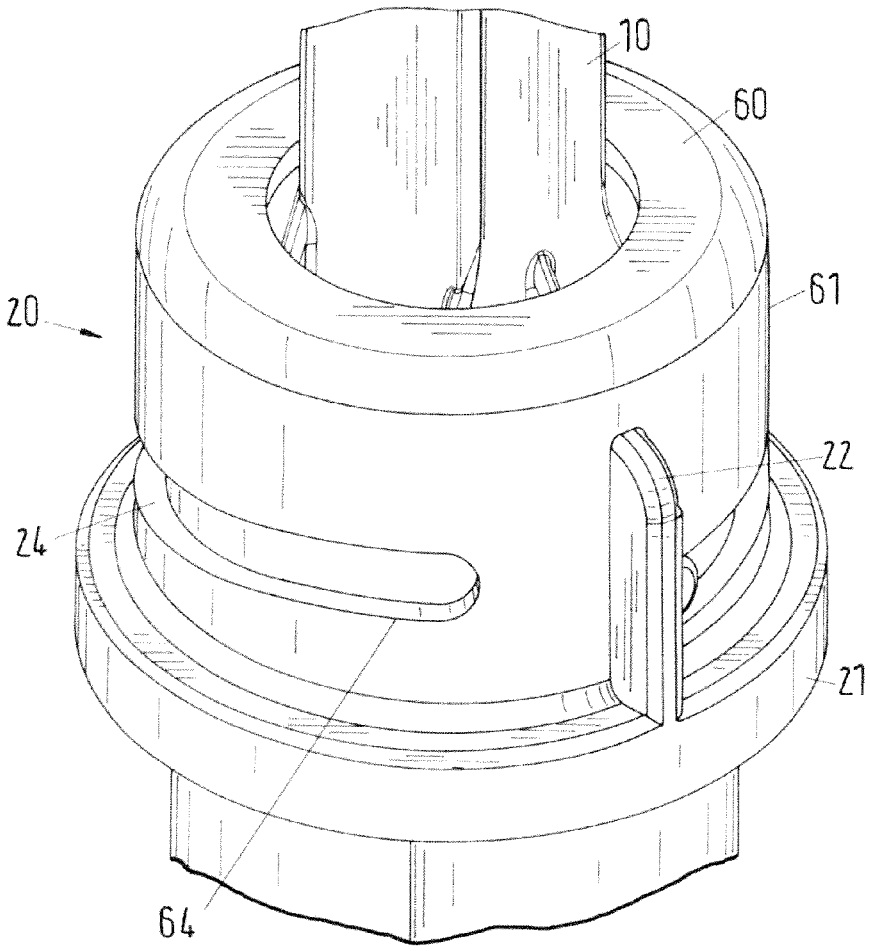
FIG. 12 is another embodiment of a mixer element of the disclosure having a quadratic cross-section.

FIG. 12 shows a variant of the second embodiment for a mixer element having a quadratic cross-section. Also in this variant the rotary cap slot 24 has a slot element 64 which forms a bayonet security with the housing button.

The rotary element 20 is rotatable, attached axially rotationally fixed in the direction at the multi-component cartridge 1 in accordance with all embodiments, wherein the rotary element 20 is attached at the multi-component cartridge 1 or at the mixer housing 10 by means of a snap and lock connection 15.

Figure 13:
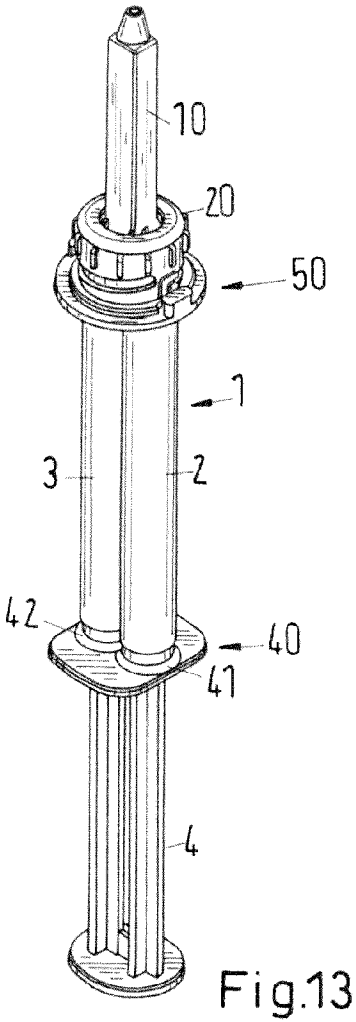
FIG. 13 is another embodiment of a dispensing apparatus according to the disclosure.

FIG. 13 shows a third embodiment of a dispensing apparatus in accordance with which the rotary cap 20 has a bayonet security with which it is attached at the multi-component cartridge 1, wherein the bayonet security differs from those of previous embodiments. At least one further slot element connects at at least one end of the rotary cap slot 24 in a normal plane with regard to the longitudinal axis of the rotary cap 20 which forms a bayonet security together with the guide element.

Figure 14:
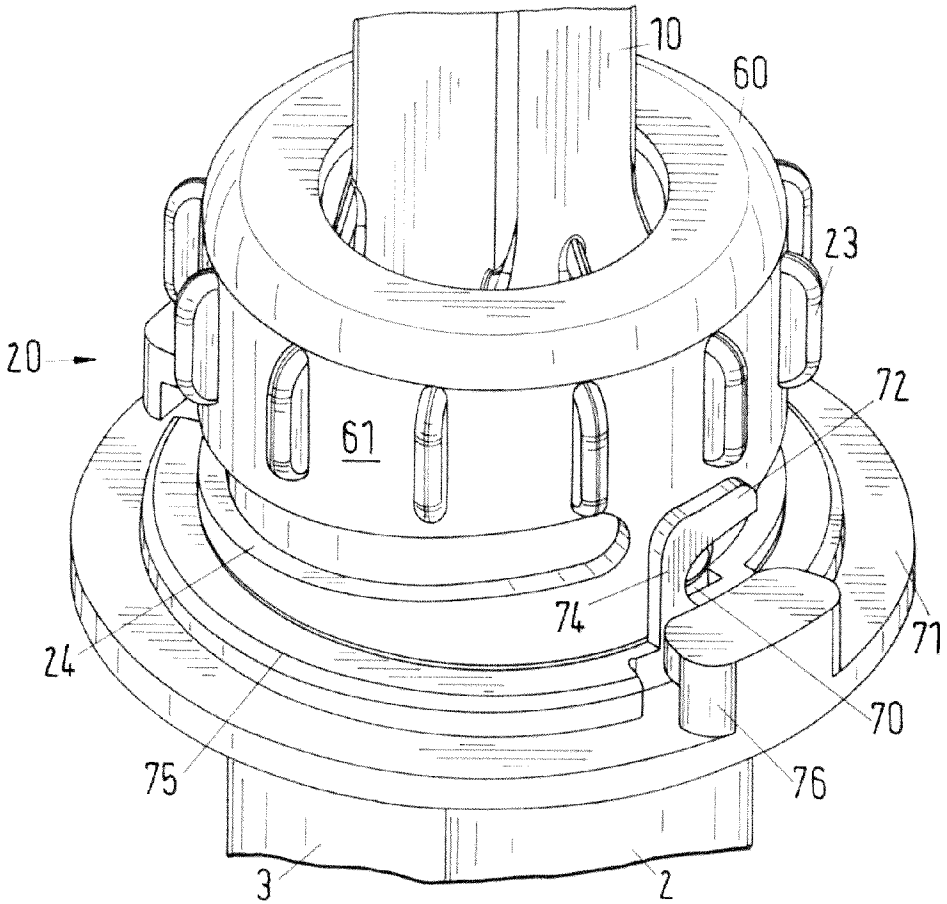
FIG. 14 is a detail of the mixer housing and the rotary cap for the dispensing apparatus of FIG. 13.

FIG. 14 shows a part of the mixer housing 10 and the rotary cap 20 for the third embodiment. The bayonet security is shown in detail in FIG. 14. The rotary cap 20 has a rotary cap slot 24 as well as a further slot element 70 which is associated with the bayonet security. Furthermore, the rotary cap has a flange 71 which also includes a part of the bayonet security.

Figure 15:
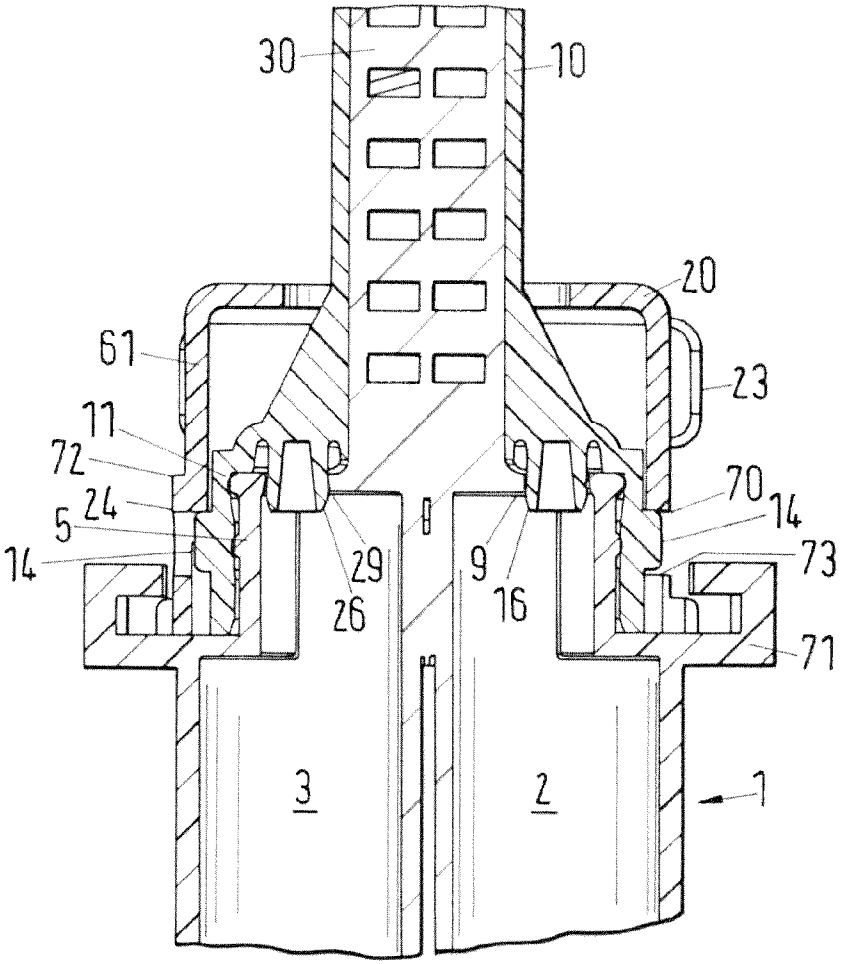
FIG. 15 is a detail of the rotary cap of the dispensing apparatus of FIG. 13.
Figure 16:
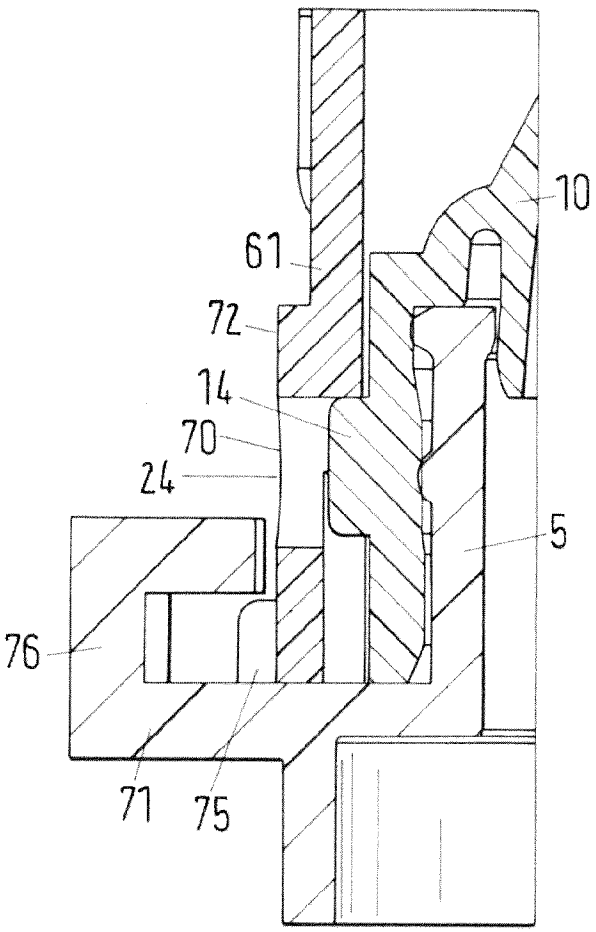
FIG. 16 is a section through the mixer housing in accordance with the dispensing apparatus of FIG. 13.

FIG. 15 shows a section through the rotary cap of the third embodiment and FIG. 16 shows a detail of the flange 70 with the bayonet security. In accordance with the embodiment of FIG. 15, the mixer element 30 is designed in one piece with the cartridge 1. The cartridge 1 includes two chambers 2, 3 which open into the outlet part 5 which each include a dispensing duct which leads to the corresponding dispensing openings 9, 29 and forms a duct through-flowed by a corresponding component whose duct cross-section is generally smaller than the cross-sectional area of the corresponding chamber.

The mixer housing 10 is placed over the mixer element 30 and onto the outlet part of the cartridge such that the closure plugs 16, 26 lock the corresponding dispensing openings 9, 29. A first sealing projection 6 and a second sealing projection 7 are arranged at the outer wall of the dispensing neck 8 of the outlet part 5 like in FIG. 4. In this position the chambers 2, 3 are fluid-sealingly closed so that an emergence of the components from the dispensing openings 9, 29 cannot take place.

The rotary cap 20 is guided over the mixer housing 10 and the mixer housing collar 11 until it contacts the flange 71. The rotary cap has a slot element 70 at its cover surface 61 for each housing button 14 so that the rotary cap 20 can be placed over the mixer housing collar. The rotary cap is placed in a predetermined position relative to the cartridge 1 at its flange 71, wherein this predetermined position is determined by the slot element 70. In FIG. 16, which shows a detail of FIG. 15, the slot element is shown in the position in which the rotary cap can be guided over the housing button 14. An extension 72 is provided in the cover surface 61 which enables that the rotary cap can be guided at the housing button 14 along the inner wall of the extension 72.

In accordance with a variant which is illustrated at the right side of FIG. 15 the cover surface 61 includes a recess 73 rather than an extension. In accordance with this variant no change of the inner diameter of the cover surface of the rotary cap takes place as is visible in the left side variant of the extension 72 which is also visible in FIG. 14.

The rotary cap is moved in the direction of the rotary cap slot 24 by means of a small rotation so that the housing button 14 can be displaced along a track predetermined by the rotary cap slot 24. The rotary direction is predetermined in the left side embodiment illustrated in FIG. 5 as well as in FIG. 14 by an abutment 74. As soon as the rotary cap is rotated relative to the flange 71 such that the housing button 14 is received in the track of the rotary cap slot, a surrounding rotary cap flange 75 interacts with an interaction element 76 of the flange 71 so that the rotary cap can be held in a loss safe manner at the flange 71. The housing button 14 and therefore the mixer housing 10 is moved away from the cartridge through a further rotation of the rotary cap. The dispensing openings 9, 29 are open when the housing button 14 is present in the highest position on the rotary cap slot 24 (see FIG. 14). In this position the components can enter into the mixer element 30 via the opened dispensing openings 9, 29 and the dispensing of the components out of the chambers of the cartridge can take place.

Figure 17:
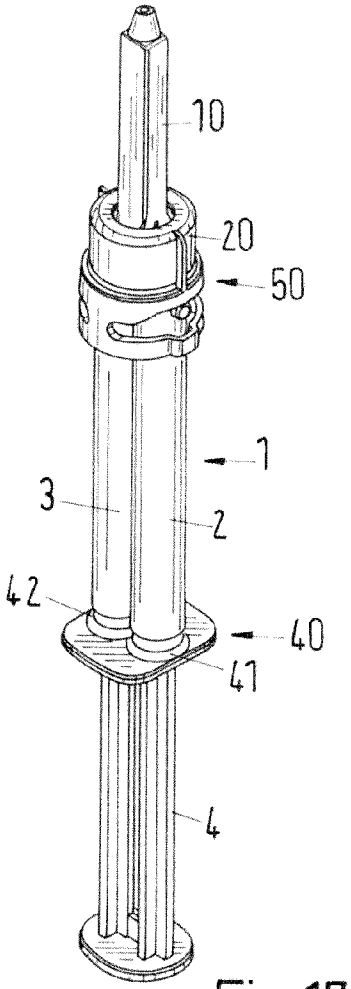
FIG. 17 is another embodiment of a dispensing apparatus according to the disclosure.

FIG. 17 shows a fourth embodiment of a dispensing apparatus in accordance with which the rotary cap has a rotary cap slot which allows two different opening positions.

Figure 18:
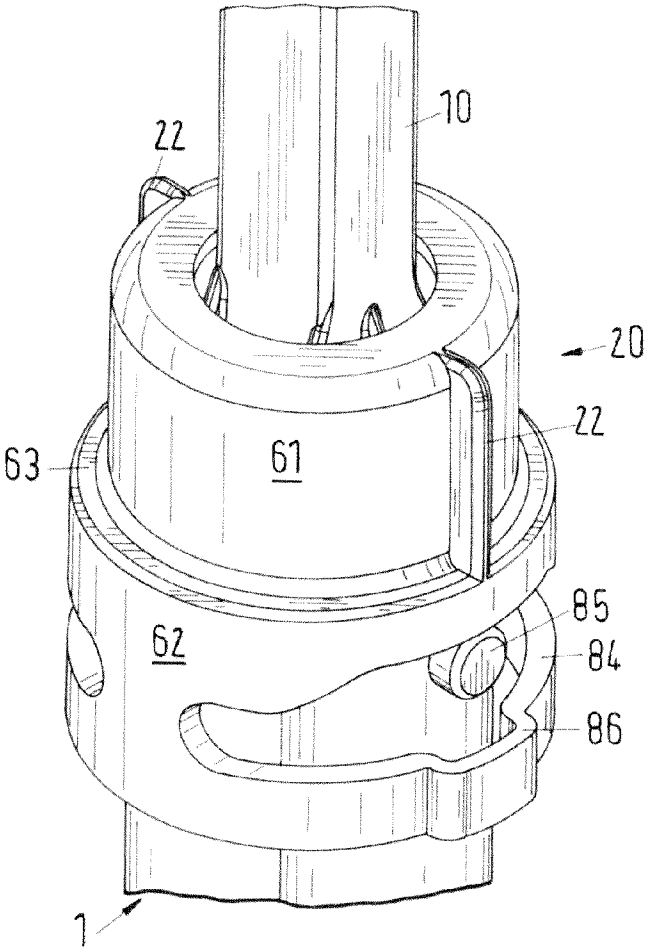
FIG. 18 is a detail of the mixer housing and the rotary cap for the dispensing apparatus of FIG. 17.

FIG. 18 shows a detail of the mixer housing and the rotary cap for the fourth embodiment. The rotary cap has a further cover surface 61 in connection at the cover surface 62 which has a larger inner diameter than the cover surface 61. The cover surface 61 is connected to the cover surface 62 via a lift 63. The cover surface 62 includes a rotary cap slot 84 along which a button element 85 is displaceable along a track predetermined by the rotary cap slot 84.

The mixer housing 10 is guided over the mixer element 30 like in the previous embodiments and is placed at the dispensing neck 8 of the cartridge on construction. Following this, the rotary cap 20 is moved over the mixer housing 10 in the direction of the outlet end 50 of the cartridge 1. The rotary cap includes a recess 86 in the cover surface 62 through which the button element 85 can be guided. The rotary cap is displaced downwardly so long in the illustration in accordance with FIG. 18 until the button element 85 contacts the upper end of the rotary cap slot 84. In this state the dispensing openings of the cartridge 1 are closed.

In order to dispense the components from the cartridge, the rotary cap is now either turned to the left or to the right. The button element 85 glides along the track predetermined by the rotary cap slot 84 so that the mixer housing 10 is displaced such that the dispensing openings are released.

Figure 20:
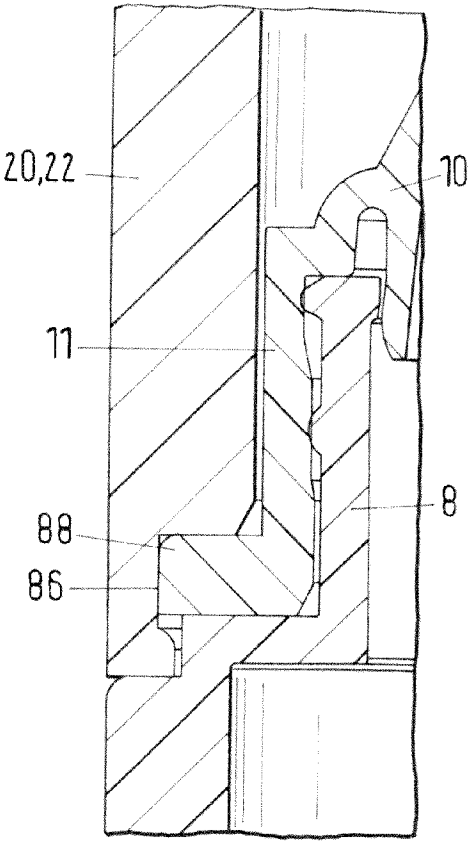
FIG. 20 is a detail of FIG. 19.
Figure 19:
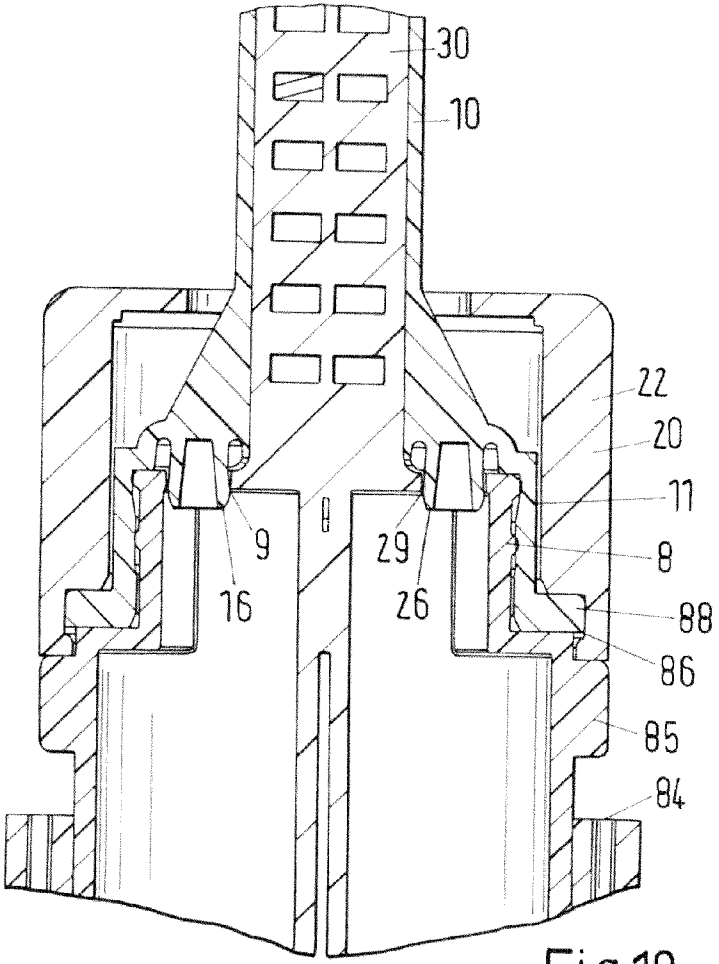
FIG. 19 is a section through the mixer housing for the dispensing apparatus of FIG. 17.

FIG. 19 shows a section through the rotary cap 20 in accordance with the fourth embodiment along the rotary wings 22 in the position illustrated in FIG. 18 in which the dispensing openings 9, 29 are locked by the closure elements 16, 26. The mixer housing 10 also has a mixer housing collar 11 which in contrast to the previous embodiments has a surrounding mixer housing flange 88. The mixer housing flange 88 interacts in a surrounding rotary cap groove 86 so that the rotary cap is rotatable relative to the mixer housing, but not axially displaceable relative to the mixer housing 10 which is illustrated, in particular in FIG. 20 which shows a detail of the mixer housing and the rotary cap for the embodiment in accordance with FIG. 19.

The button element 85 is attached at the wall of the cartridge 1.

In accordance with a further non-illustrated embodiment the rotary element 20 has a rotary cap slot 24 running helically in the longitudinal direction of the mixer element 30 and the mixer housing 10 has a guide element cooperating with the rotary cap slot 24.

The mixer housing 10 has a housing groove running helically at its outer surface 25 in the longitudinal direction of the mixer element 30 and the rotary cap 20 has a guide element cooperating with the housing groove.

The rotary cap slot 24 or the housing groove are designed, in particular such that the rotation of the rotary cap 20 about the longitudinal axis of the mixer element 30 from the closed position to the dispensing position amounts to 270° and less, in particular to 90° to 180° with regard to a full circle of 360°.

The outer surface 51 of the outlet part 5 and/or the inner wall 13 of the mixer housing 10 can have sealing means 6, 7 in order to prevent a leaking emergence of the components to be mixed between the mixer housing 10 and the multi-component cartridge 1 during the expulsion of the components to be mixed from the chambers 2, 3.

The mixer housing in accordance with each of the previous embodiments can be designed as transparent or translucent. This enables a visual control on whether the mixer is delivering satisfactory results, in particular when differently colored components are mixed. The mixer housing can also be opaque, in particular when polypropylene or polystyrol are used as materials.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

What is claimed is:

1. A dispensing apparatus for mixing and dispensing multi-component masses including a multi-component cartridge or a multi-component syringe having a plurality of chambers, a mixer element having a longitudinal axis and a mixer housing which can be placed over the mixer element, said mixer element and the multi-component cartridge being formed of a single piece, wherein each chamber has a dispensing opening closable by means of closure elements fixed at the mixer housing, wherein an outer surface of the mixer element and an inner wall of the mixer housing have a cooperating guide element which only allows a displacement of the mixer housing at the mixer element along the longitudinal axis of the mixer element and the mixer housing is axially displaceably connected to the multi-component cartridge by a connection element, wherein the multi-component cartridge can be transferred from a closed position locking the dispensing openings of said each chamber into a dispensing position freeing the dispensing openings, characterized in that the guide element is designed such that the mixer housing and the mixer element are only displaceable against one another in an axial direction in the closed position, the dispensing position, and a path between the closed position and the dispensing position, and the connection element is a rotary element, wherein the rotary element, the mixer housing and the multi-component cartridge have a cooperating interaction element which, in response to a rotation of the rotary element, is configured to result in an axial relative movement between the mixer housing and the multi-component cartridge, wherein the rotary element has a rotary cap slot running helically in the longitudinal direction of the mixer element and the mixer housing has a guide element cooperating with the rotary cap slot.

2. A dispensing apparatus in accordance with claim 1, wherein the guide element for the axial displacement of the mixer housing at the mixer element is formed by a form-fitting like formation of the inner wall of the mixer housing and an outer wall of the mixer element, wherein, at least the outer wall of the mixer element and the inner wall of the mixer housing surrounding the mixer element each have a polygonal cross-section, which is rectangular or elliptical cross-section.

3. A dispensing apparatus in accordance with claim 1, wherein the guide element for the axial displacement of the mixer housing at the mixer element is formed by at least one tongue and groove arrangement extending in axial direction.

4. A dispensing apparatus in accordance with claim 1, wherein the rotary element is attached rotatably, but rotationally fixedly in the axial direction, to the multi-component cartridge.

5. A dispensing apparatus in accordance with claim 4, wherein the rotary element is attached at the multi-component cartridge or at the mixer housing by means of a snap and lock connection.

6. A dispensing apparatus in accordance with claim 4, wherein the rotary element is rotatably and axially fixedly attached at the multi-component cartridge or at the mixer housing by means of a bayonet connection.

7. A dispensing apparatus in accordance with claim 4, wherein the rotary element is a rotary cap which has a cover with a centrally arranged recess for guiding through the mixer housing and a surrounding wall.

8. A dispensing apparatus in accordance with claim 7, wherein the rotary cap has an at least partially surrounding ring-shaped bead-like indentation at a free boundary region and an at least partially surrounding ring-shaped molding or groove corresponding therewith at the outer surface of the multi-component cartridge or the mixer housing and the free boundary region of the rotary cap is elastically deformable for the placing over of the bulge-shaped indentation over the ring-shaped molding or groove of the multi-component cartridge or the mixer housing.

9. A dispensing apparatus in accordance with claim 1, wherein the rotary element can be fixed in the closed position or in the dispensing position of the multi-component cartridge.

10. A dispensing apparatus in accordance with claim 1, wherein a further slot element adjoins at least one end of the rotary cap slot in a normal plane with regard to the longitudinal axis of the rotary cap which forms a bayonet security together with the guide element.

11. A dispensing apparatus in accordance with claim 1, wherein the rotary cap slot or the housing groove are formed such that the rotation of the rotary cap about the longitudinal axis of the mixer element from the closed position to the dispensing position amounts to 270° and less, in particular 90° to 180° with regard to a full circle of 360°.

12. A dispensing apparatus in accordance with claim 1, wherein the multi-component cartridge has an outlet part at an inlet end of the mixer housing which is overlappingly formed by the mixer housing and the outer surface of the outlet part or the inner wall of the mixer housing has sealing means in order to prevent a leaking emergence of the component between the mixer housing and the multi-component cartridge during the expulsion of the components to be mixed from the chambers.

13. A dispensing apparatus for mixing and dispensing multi-component masses including a multi-component cartridge or a multi-component syringe having a plurality of chambers, a mixer element having a longitudinal axis and a mixer housing which can be placed over the mixer element, said mixer element and the multi-component cartridge being formed of a single piece, wherein each chamber has a dispensing opening closable by means of closure elements fixed at the mixer housing, wherein an outer surface of the mixer element and an inner wall of the mixer housing have a cooperating guide element which only allows a displacement of the mixer housing at the mixer element along the longitudinal axis of the mixer element and the mixer housing is axially displaceably connected to the multi-component cartridge by a connection element, wherein the multi-component cartridge can be transferred from a closed position locking the dispensing openings of said each chamber into a dispensing position freeing the dispensing openings, characterized in that the guide element is designed such that the mixer housing and the mixer element are only displaceable against one another in an axial direction in the closed position, the dispensing position, and a path between the closed position and the dispensing position, and the connection element is a rotary element, wherein the rotary element, the mixer housing and the multi-component cartridge have a cooperating interaction element which, in response to a rotation of the rotary element, is configured to result in an axial relative movement between the mixer housing and the multi-component cartridge, wherein the mixer housing has a housing groove running helically at an outer surface of the mixer housing in the longitudinal direction of the mixer element and the rotary cap has a guide element cooperating with the housing groove.

14. A dispensing apparatus in accordance with claim 13, wherein a further groove element adjoins at least one end of the housing groove in a normal plane with regard to the longitudinal axis of the mixer housing, said groove element forming a bayonet security together with the guide element.

* * * * *